US009285711B2

(12) United States Patent
Tsutsumi et al.

(10) Patent No.: US 9,285,711 B2
(45) Date of Patent: Mar. 15, 2016

(54) DEVELOPING DEVICE AND IMAGE FORMING APPARATUS

(71) Applicant: FUJI XEROX CO., LTD., Minato-ku, Tokyo (JP)

(72) Inventors: Yasuyuki Tsutsumi, Kanagawa (JP); Yoshinobu Kariya, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 13/970,889

(22) Filed: Aug. 20, 2013

(65) Prior Publication Data

US 2014/0286676 A1 Sep. 25, 2014

(30) Foreign Application Priority Data

Mar. 22, 2013 (JP) ..... 2013-060881

(51) Int. Cl.
*G03G 15/08* (2006.01)

(52) U.S. Cl.
CPC ..... *G03G 15/0893* (2013.01); *G03G 15/0879* (2013.01); *G03G 15/0889* (2013.01); *G03G 15/0891* (2013.01)

(58) Field of Classification Search
CPC ..... G03G 15/0887; G03G 15/0889; G03G 15/0891; G03G 15/0893
USPC ..... 399/254, 256
See application file for complete search history.

(56) References Cited

U.S. PATENT DOCUMENTS 4,864,349 A * 9/1989 Ito ..... 399/256
5,510,882 A * 4/1996 Kikuta et al. ..... 399/257
6,324,369 B1 * 11/2001 Yamaguchi et al. ..... 399/254
6,473,584 B1 10/2002 Hibino et al.
2006/0115302 A1 * 6/2006 Hosokawa et al. ..... 399/254
2006/0182467 A1 * 8/2006 Aoki et al. ..... 399/254
2008/0181672 A1 * 7/2008 Hatakeyama et al. ..... 399/254

FOREIGN PATENT DOCUMENTS

JP 01142771 A 6/1989
JP 10-039592 A 2/1998
JP 2000347488 A 12/2000
JP 2001-154471 A 6/2001
JP 2006-178405 A 7/2006

OTHER PUBLICATIONS

Communication dated Aug. 18, 2015 from the Japanese Patent Office in counterpart application No. 2013-060881.

* cited by examiner

*Primary Examiner* — Benjamin Schmitt
(74) *Attorney, Agent, or Firm* — Sughrue Mion, PLLC

(57) ABSTRACT

A developing device includes a developer container including a first chamber and a second chamber arranged along a lateral direction, which crosses a gravitational direction, developer circulating through the first chamber and the second chamber; a transporting member rotatably disposed in the first chamber; and a supply member rotatably disposed in the second chamber. A lower end position of the supply member and a lower end position of the transporting member in the gravitational direction are at the same level. While the supply member and the transporting member are rotating, an upper surface of developer contained in the first chamber and an upper surface of developer contained in the second chamber are at levels not higher than an upper end position of the transporting member but not lower than an upper end position of the supply member in the gravitational direction.

13 Claims, 7 Drawing Sheets

DEVELOPING DEVICE AND IMAGE FORMING APPARATUS

CROSS-REFERENCE TO RELATED APPLICATIONS

This application is based on and claims priority under 35 USC 119 from Japanese Patent Application No. 2013-060881 filed Mar. 22, 2013.

BACKGROUND

Technical Field

The present invention relates to developing devices and image forming apparatuses.

SUMMARY

According to an aspect of the invention, a developing device includes a developer container including a first chamber and a second chamber arranged along a lateral direction, which crosses a gravitational direction, developer circulating through the first chamber and the second chamber; a transporting member rotatably disposed in the first chamber, the transporting member transporting the developer in a first direction extending along an axis of the transporting member; and a supply member rotatably disposed in the second chamber, the supply member having an outer diameter smaller than an outer diameter of the transporting member, the supply member supplying the developer to a developer holding member while transporting the developer in a direction opposite to the first direction. A lower end position of the supply member and a lower end position of the transporting member in the gravitational direction are at the same level. While the supply member and the transporting member are rotating, an upper surface of developer contained in the first chamber and an upper surface of developer contained in the second chamber are at a level not higher than an upper end position of the transporting member but not lower than an upper end position of the supply member in the gravitational direction.

BRIEF DESCRIPTION OF THE DRAWINGS

Exemplary embodiments of the present invention will be described in detail based on the following figures, wherein.

DETAILED DESCRIPTION

A developing device and an image forming apparatus according to an exemplary embodiment will be described.

Entire Configuration

Figure 1:
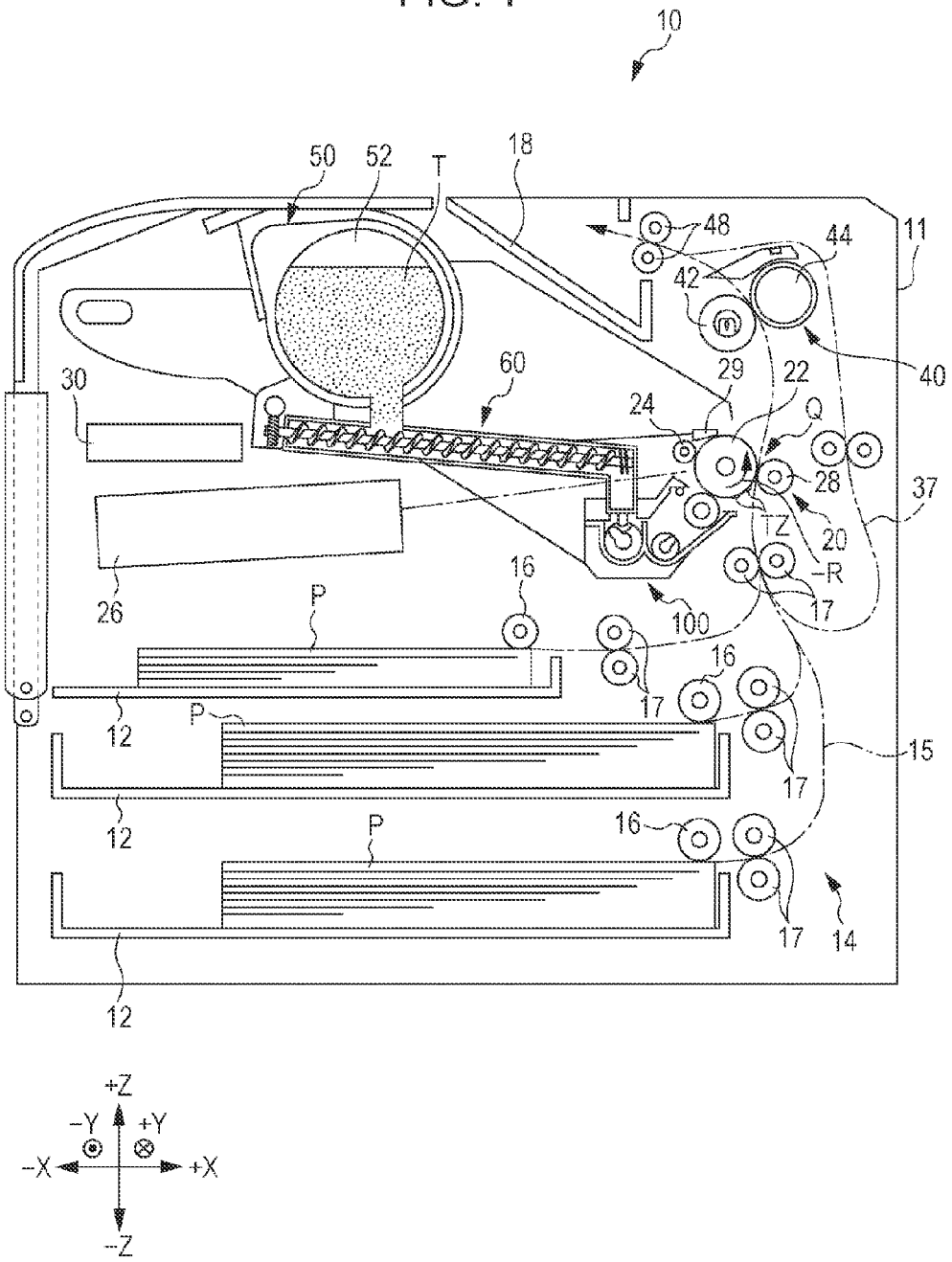
FIG. 1 illustrates the entire configuration of an image forming apparatus according to an exemplary embodiment.

FIG. 1 illustrates an image forming apparatus 10 according to an exemplary embodiment. The image forming apparatus 10 includes a cabinet 11, which houses various components. Specifically, the cabinet 11 houses sheet containing units 12, an image forming unit 20, and a sheet transporting unit 14. The sheet containing units 12 contain recording sheets P, which are examples of recording media. The image forming unit 20 forms a toner image TZ (an example of a developer image) on a recording sheet P. The sheet transporting unit 14 transports recording sheets P from the sheet containing units 12 to an ejecting portion 18, which will be described below.

The cabinet 11 also houses a fixing device 40 and a controller 30. The fixing device 40 fixes the toner image TZ, formed on the recording sheet P by the image forming unit 20, to the recording sheet P. The controller 30 controls an operation of each component of the image forming apparatus 10. An ejecting portion 18 is formed on an upper portion of the cabinet 11. The recording sheet P to which the image has been fixed by the fixing device 40 is ejected to the ejecting portion 18.

In the following description, the arrows Z illustrated in FIG. 1 denote an apparatus height direction and the arrows X illustrated in FIG. 1 denote an apparatus width direction. In addition, the arrows Y that are perpendicular to (that cross at right angles to) the apparatus height direction and the apparatus width direction denote an apparatus depth direction. When the image forming apparatus 10 is viewed from a side on which users (not illustrated) stand (viewed from the front), the apparatus height direction is denoted by a Z direction, the apparatus width direction is denoted by an X direction, and the apparatus depth direction is denoted by a Y direction.

When needed, the image forming apparatus 10 is described using the following positional words in relation to the X direction, Y direction, and Z direction when the image forming apparatus 10 is viewed from the front: the upper and lower sides are respectively denoted by a +Z side and a −Z size; the right and left sides are respectively denoted by a +X side and a −X side; and the back and front sides are respectively denoted by a +Y side and a −Y side.

The sheet transporting unit 14 includes a transport path 15 along which a recording sheet P is transported. The transport path 15 extends, for example, from the −Z side to the +Z side on the +X side of the image forming apparatus 10. The sheet transporting unit 14 includes pick-up rollers 16 and multiple transporting rollers 17. The pick-up rollers 16 pick up recording sheets P contained in the sheet containing units 12 and feed the recording sheets P to the transport path 15. The transporting rollers 17 are disposed along the transport path 15 and transport the recording sheets P fed by the pick-up rollers 16 to a transfer position Q, which will be described below. The sheet transporting unit 14 also includes ejecting rollers 48. The ejecting rollers 48 are disposed at a downstream end portion of the transport path 15 in the direction in which the recording sheet P is transported. The ejecting rollers 48 eject the recording sheet P to the ejecting portion 18.

A reverse transport path 37 is disposed on the +X side of the transport path 15 inside the cabinet 11. A recording sheet P having one surface to which the toner image TZ is fixed is reversed along the reverse transport path 37 and then transported back to the transfer position Q. When toner images TZ are to be formed on both surfaces of a recording sheet P in the image forming apparatus 10, a recording sheet P having one surface to which a toner image TZ has been fixed is reversed by the ejecting rollers 48, guided to the reverse transport path 37 again, and fed back to the transfer position Q again.

Image Forming Unit

The image forming unit 20 includes a photoconductor 22, which is an example of an image holding member that holds a latent image (not illustrated). A charging roller 24, an exposure device 26, a developing device 100, a transfer roller 28, and a cleaning blade 29 are disposed around the photoconductor 22 in order from the upstream side in the direction in which the photoconductor 22 rotates. The transfer roller 28 is an example of a transfer unit.

The photoconductor 22 has a cylindrical shape and is driven by a driving unit, not illustrated, to rotate around its axis that extends in the Y direction. A photosensitive layer (not illustrated) that has, for example, a negative polarity is formed on the outer circumferential surface of the photoconductor 22. An inner base (not illustrated) of the photoconductor 22 is grounded. When the image forming apparatus 10 is viewed from the −Y side to the +Y side, the direction in which the photoconductor 22 rotates is a counterclockwise direction (hereinafter referred to as a −R direction). The photoconductor 22 may include an overcoat layer on the outer circumferential surface.

For example, the charging roller 24 is disposed so as to face the outer circumferential surface of the photoconductor 22. The charging roller 24 receives a voltage and negatively charges the outer circumferential surface (photosensitive layer) of the photoconductor 22 by using a potential difference between the photoconductor 22 and the charging roller 24.

The exposure device 26 forms a latent image on the outer circumferential surface of the photoconductor 22 on the basis of an image signal transmitted from the controller 30. Examples of image signals transmitted from the controller 30 include an image signal that the controller 30 receives from an external apparatus. The detail of the developing device 100 will be described below.

The transfer roller 28 faces the photoconductor 22 such that the transfer roller 28 and the photoconductor 22 sandwich the transport path 15 therebetween. For example, a voltage having a polarity opposite to the polarity of the charge with which toner T is charged is applied to the transfer roller 28 by a power source (not illustrated) and a potential difference is generated between the transfer roller 28 and the photoconductor 22. The transfer roller 28 nips a recording sheet P together with the photoconductor 22 and transports the recording sheet P to the +Z side (downstream side of the transport path 15). A portion between the transfer roller 28 and the photoconductor 22 serves as the transfer position Q at which a toner image TZ (developer image) formed on the photoconductor 22 is transferred to a recording sheet P.

The fixing device 40 includes a heating roller 42 and a pressure roller 44. The fixing device 40 fixes a toner image TZ that has been transferred to a recording sheet P to the recording sheet P by heating the toner image TZ using the heating roller 42 and by pressing the toner image TZ using the pressure roller 44. The ejecting rollers 48, which have been described above, are disposed on the +Z side (downstream side in the transportation direction) of the fixing device 40.

A toner cartridge 50 containing toner T is disposed on the +Z side (upper side) of the exposure device 26 so as to be attachable to and detachable from the image forming apparatus 10 in the Y direction. The toner cartridge 50 has a toner containing chamber 52 in which the toner T is contained. A toner transporting device 60 is disposed so as to connect the toner cartridge 50 to the developing device 100. The toner transporting device 60 transports the toner T from the toner containing chamber 52 to the developing device 100.

Figure 2:
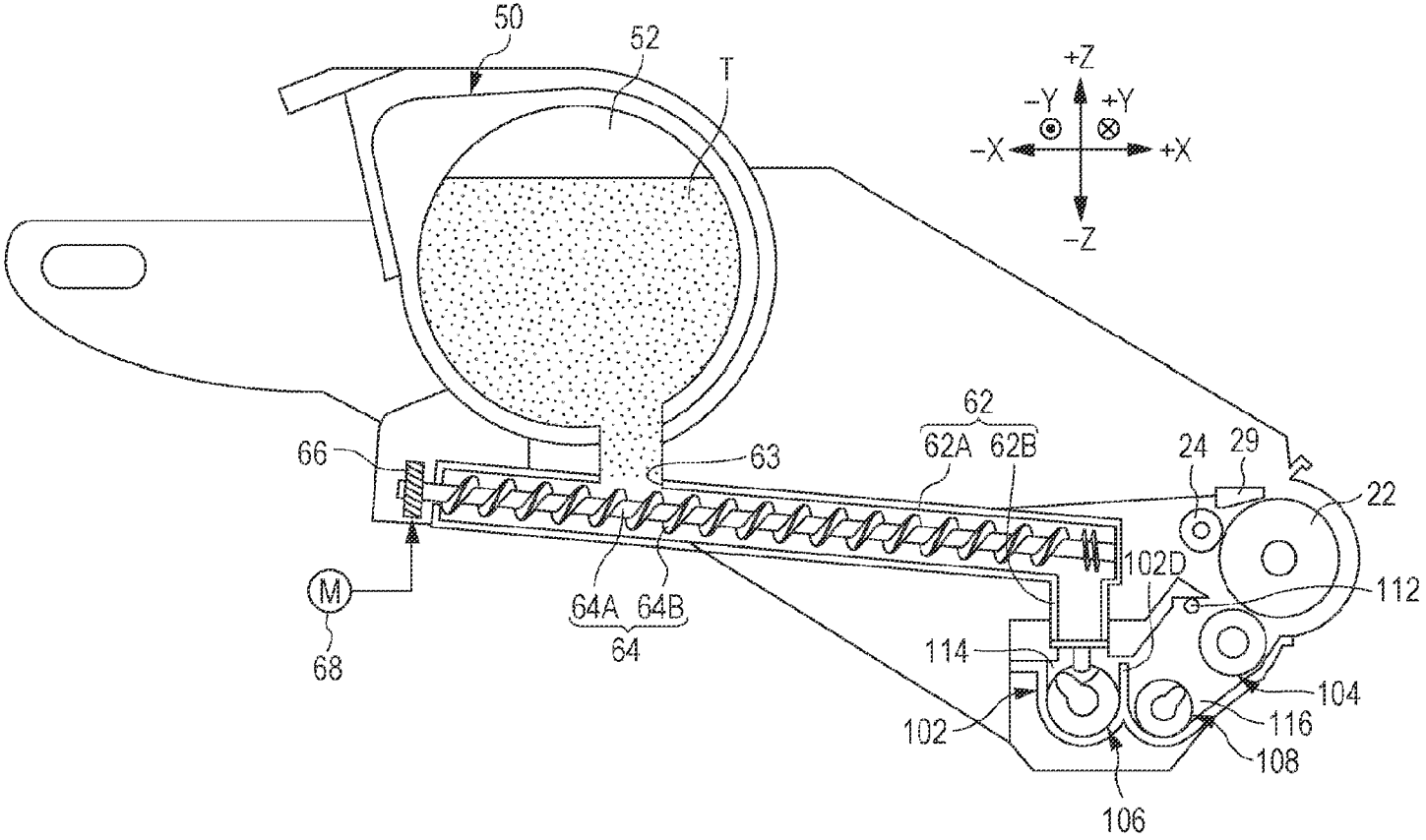
FIG. 2 schematically illustrates configurations of a developing device and a toner transporting device according to the exemplary embodiment.

As illustrated in FIG. 2, the toner transporting device 60 includes a transportation pipe 62 along which the toner T is transported from the toner containing chamber 52 to the developing device 100. The transportation pipe 62 includes a lateral pipe 62A and a vertical pipe 62B. The lateral pipe 62A obliquely extends to the +X side so as to be inclined downward to the −Z side. The vertical pipe 62B extends to the −Z side from a +X side end portion of the lateral pipe 62A toward the developing device 100.

A supply port 63, which is open to the +Z side, is formed in a portion of the lateral pipe 62A positioned on the −X side of the center of the lateral pipe 62A. Thus, the toner T contained in the toner containing chamber 52 falls into the lateral pipe 62A through the supply port 63. A carrying member 64 that carries (transports) the toner T to the +X side is disposed inside the lateral pipe 62A.

The carrying member 64 includes a rotation shaft 64A and a helical portion 64B. The axis of the rotation shaft 64A extends in the direction in which the lateral pipe 62A extends. The helical portion 64B is helically formed around the rotation shaft 64A. The −X side end of the rotation shaft 64A protrudes beyond the lateral pipe 62A to the −X side and a gear 66 is attached to the protruding −X side end of the rotation shaft 64A. The gear 66 is driven to rotate by a motor 68. Thus, the toner T that has fallen into the lateral pipe 62A from the toner containing chamber 52 is transported to the +X side by the carrying member 64 and is supplied to the developing device 100 through the vertical pipe 62B.

Image Forming Operation

Now, an image forming operation performed by the image forming apparatus 10 will be described.

As illustrated in FIG. 1, in the image forming apparatus 10, a recording sheet P picked up by a pick-up roller 16 from one sheet containing unit 12 is fed to the transfer position Q by the multiple transporting rollers 17.

In the image forming unit 20, the photoconductor 22 is charged by the charging roller 24 and then exposed to light by the exposure device 26, so that an electrostatic latent image is formed on the outer circumferential surface of the photoconductor 22. After the electrostatic latent image is developed by the developing device 100, which will be described in detail below, a toner image TZ of, for example, black is formed on the photoconductor 22. This black toner image TZ is transferred by the transfer roller 28 to the recording sheet P at the transfer position Q.

The recording sheet P to which the toner image TZ has been transferred is transported to the fixing device 40 and the toner image TZ is fixed to the recording sheet P by the fixing device 40. In the case of forming a toner image TZ on only one surface of a recording sheet P, the recording sheet P is ejected by the ejecting rollers 48 to the ejecting portion 18 after the toner image TZ is fixed to the recording sheet P.

In the case of forming toner images TZ on both surfaces of a recording sheet P, the recording sheet P is reversed by the ejecting rollers 48 after one toner image TZ is formed on one surface and then transported to the reverse transport path 37.

Thereafter, the recording sheet P is transported from the reverse transport path 37 to the transfer position Q again, at which a toner image TZ is similarly formed on an opposite surface (back surface) on which the toner image TZ has not yet been formed. The recording sheet P is then ejected by the ejecting rollers 48 to the ejecting portion 18. In this manner, the image forming operation is performed by the image forming apparatus 10.

Configuration of Related Portion

Now, the developing device 100 is described.

Figure 3:
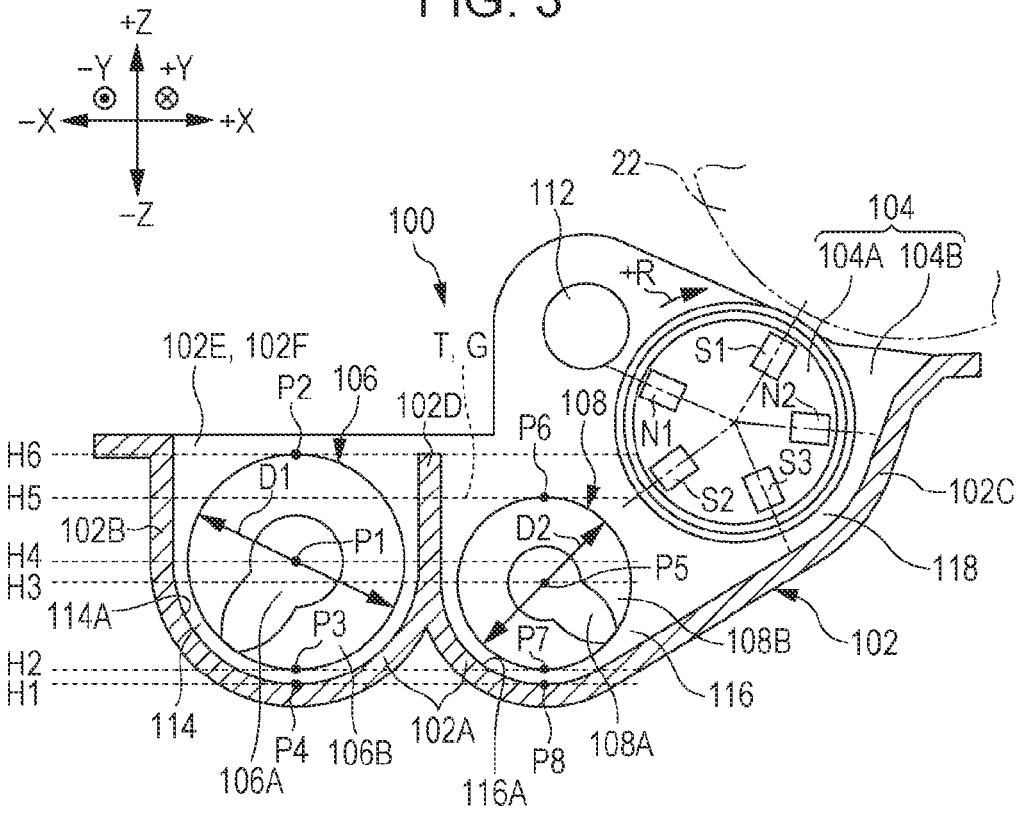
FIG. 3 is a vertical cross-sectional view of the developing device according to the exemplary embodiment.

As illustrated in FIG. 3, the developing device 100 includes a housing 102, which is an example of a developer container, a development roller 104, which is an example of a developer holding member, a first agitating member 106, which is an example of a transporting member, and a second agitating member 108, which is an example of a supply member. The developing device 100 also includes a columnar thickness regulating member 112, which regulates the thickness of a layer of developer G held on the outer circumferential surface of the development roller 104. In FIG. 3, the cross section is not hatched for convenience of illustration of each component.

Developer

The developer G is a two-component developer containing, for example, a black toner T that is to be negatively charged and a magnetic carrier (not illustrated) that is to be positively charged.

Housing

When the housing 102 is viewed in a cross section taken along the X-Z plane, the housing 102 has an oblong shape in which the dimension in the X direction is longer than the dimension in the Z direction. The housing 102 includes a first agitating chamber 114 and a second agitating chamber 116. The first agitating chamber 114 is formed on the −X side and serves as an example of a first chamber. The second agitating chamber 116 is formed to the +X side of the first agitating chamber 114 and serves as an example of a second chamber. The housing 102 also includes a development chamber 118 that contains the development roller 104. The development chamber 118 is formed to the +X side and to the +Z side (obliquely upward) of the second agitating chamber 116. In the exemplary embodiment, the Z direction is an example of the gravitational direction and the X direction is an example of the lateral direction.

The housing 102 also includes a bottom wall 102A, a side wall 102B, and an oblique wall 102C. The bottom wall 102A includes two curved portions that protrude to the −Z side when viewed in the Y direction. The side wall 102B is formed to the −X side end of the bottom wall 102A so as to stand upright. The oblique wall 102C is formed to the +X side of the bottom wall 102A so as to extend obliquely. The housing 102 also includes a partition wall 102D and side walls 102E and 102F. The partition wall 102D is formed on a center portion of the bottom wall 102A so as to stand upright and divides the first agitating chamber 114 and the second agitating chamber 116 from each other. The side walls 102E and 102F are formed to the +Y side end and the −Y side end of the bottom wall 102A so as to stand upright and face each other in the Y direction.

Figure 4:
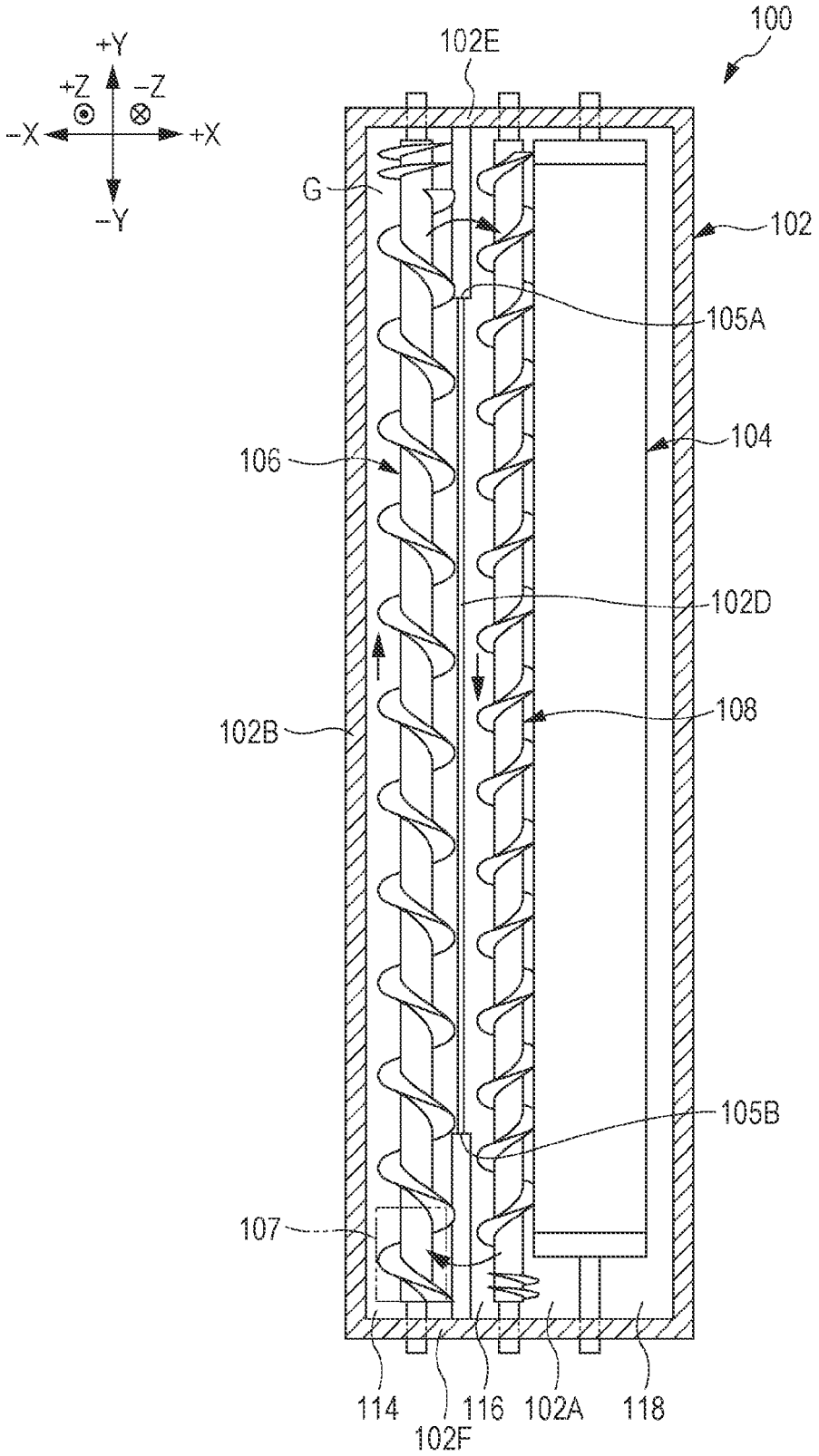
FIG. 4 is a plane cross section of the developing device according to the exemplary embodiment.

As illustrated in FIG. 4, a first opening 105A that penetrates the partition wall 102D in the X direction is formed in a +Y side end portion of the partition wall 102D so as to connect the first agitating chamber 114 and the second agitating chamber 116. In addition, a second opening 105B that penetrates the partition wall 102D in the X direction is formed in a −Y side end portion of the partition wall 102D so as to connect the first agitating chamber 114 and the second agitating chamber 116. Thus, the developer G is capable of circulating through the first agitating chamber 114 and the second agitating chamber 116.

The first agitating member 106 is rotatably disposed in the first agitating chamber 114 such that the axis of the first agitating member 106 extends in the Y direction. A second agitating member 108 is rotatably disposed in the second agitating chamber 116 such that the axis of the second agitating member 108 extends in the Y direction. Specifically, the developer G contained in the housing 102 circulates through the first agitating chamber 114 and the second agitating chamber 116 as a result of rotation of the first agitating member 106 and the second agitating member 108.

As illustrated in FIG. 3, the second agitating chamber 116 and the development chamber 118 are continuous with each other without a partition member interposed therebetween. The +Z side of the housing 102 is covered by a lid member (not illustrated). A supply hole 107 (see FIG. 4) is formed so as to penetrate the lid member in the Z direction at a position over the −Y side end of and the +Z side of the first agitating chamber 114. The −Z side end of the vertical pipe 62B (see FIG. 2) is connected to the supply hole 107.

Development Roller

The development roller 104 includes a magnet roller 104A and a development sleeve 104B. The magnet roller 104A has a cylindrical shape and the axis of the magnet roller 104A extends in the Y direction. The development sleeve 104B has a cylindrical shape and is supported on the outer side of the magnet roller 104A so as to be coaxial with the magnet roller 104A and rotatable in a +R direction. Specifically, the magnet roller 104A is disposed inside the development sleeve 104B. Shaft portions (not illustrated) that protrude to the +Y side and −Y side are formed on both Y side end portions of the magnet roller 104A. These shaft portions are fixed to the side walls 102E and 102F.

The magnet roller 104A has multiple magnetic poles, which will be described below, along the circumference of the magnet roller 104A. Each magnetic pole exerts a magnetic force that attracts or repels the developer G. Specifically, when viewed in the Y direction, a pick-up pole S2, a layer forming pole N1, a development pole S1, a transportation pole N2, and a repelling pole S3 are formed in order in the +R direction from the lower left side near the second agitating member 108.

The pick-up pole S2 attracts the developer G. The layer forming pole N1 is disposed so as to face the thickness regulating member 112 and regulates the thickness of a layer of the developer G. The development pole S1 is disposed so as to face the photoconductor 22 and forms the developer G (carrier) into a brush form. The transportation pole N2 causes the outer circumferential surface of the development sleeve 104B to hold the developer G (carrier), which has been subjected to development. The repelling pole S3 separates the developer G from the outer circumferential surface of the development sleeve 104B. Lines of magnetic force are generated from the layer forming pole N1 to the development pole S1 and to the pick-up pole S2 and lines of magnetic force are formed from the transportation pole N2 to the development pole S1 and to the repelling pole S3. These lines of magnetic force are not illustrated.

Now, the positions of the magnetic poles are described using the position of the clock hand, i.e., the +Z side position (top position) is regarded as twelve o'clock and the −Z side position (bottom position) is regarded as six o'clock when the magnet roller 104A is viewed in the Y direction. For example, the pick-up pole S2 is positioned at an approximately eight o'clock position and the layer forming pole N1 is positioned at an approximately ten o'clock position. The development pole S1 is positioned at an approximately one o'clock position. The transportation pole N2 is positioned at an approximately three o'clock position and the repelling pole S3 is positioned at an approximately five o'clock position.

The development sleeve 104B is, for example, a cylindrical component made of aluminum. Cap-shaped supporting members (not illustrated) are attached to both Y side end portions of the development sleeve 104B to cover the end portions. Outer rings (not illustrated) of bearings are fixed to the supporting members. The shaft portions (not illustrated) of the magnet roller 104A are fixed to inner rings of the bearings. Thus, the development sleeve 104B is rotatable with respect to the magnet roller 104A in the +R direction. The development sleeve 104B is driven to rotate in the +R direction by a driving unit including a motor and a gear, which are not illustrated.

Multiple grooves (not illustrated) that extend in the Y direction are formed in the outer circumferential surface of the development sleeve 104B. The development sleeve 104B is disposed so as to be parallel to the photoconductor 22 (extend in the Y direction) and so as to face the outer circumferential surface of the photoconductor 22. At the position at which the development sleeve 104B faces the photoconductor 22 (in a development area), the development sleeve 104B moves in the same direction as movement of the development sleeve 104B so as not to impede rotation of the photoconductor 22, and holds the developer G on its outer circumferential surface and thus the electrostatic latent image (latent image) on the photoconductor 22 is developed with toner T.

First Agitating Member

The first agitating member 106 includes a rotation shaft 106A and a helical blade portion 106B. The rotation shaft 106A extends in the Y direction and the helical blade portion 106B is formed around the outer circumference of the rotation shaft 106A. The helix of the first agitating member 106 is wound in the direction opposite to the direction in which the helix of the second agitating member 108, which will be described below, is wound. The first agitating member 106 rotates in the same direction as the second agitating member 108 and transports the developer G to the +Y side (in the Y direction). The developer G transported by the first agitating member 106 is fed to the second agitating chamber 116 through the first opening 105A.

Second Agitating Member

The second agitating member 108 includes a rotation shaft 108A and a helical blade portion 108B. The rotation shaft 108A extends in the Y direction and the helical blade portion 108B is formed around the outer circumference of the rotation shaft 108A. When the second agitating member 108 is viewed in a cross section taken along the X-Z plane, the outermost diameter D2 of the second agitating member 108 is smaller than the outermost diameter D1 of the first agitating member 106. The helix of the second agitating member 108 is wound in the direction opposite to a direction in which the helix of the first agitating member 106 is wound. The second agitating member 108 rotates in the same direction as the first agitating member 106 and transports the developer G to the −Y side (in the Y direction).

The developer G transported by the second agitating member 108 and not supplied to the development roller 104 is fed to the first agitating chamber 114 through the second opening 105B. In other words, the developer G is circularly transported by the first agitating member 106 and the second agitating member 108.

The second agitating member 108 is disposed upstream from the thickness regulating member 112 in the direction in which the development sleeve 104B rotates (in the +R direction) so as to face the development sleeve 104B. In addition, the rotation axis of the second agitating member 108 extends in the same direction as the axis of the development sleeve 104B (in the Y direction). The second agitating member 108 transports the developer G in the Y direction by rotating and concurrently supplies the developer G to the development sleeve 104B.

The developer G contained in the development chamber 118 is transported as a result of rotation of the development sleeve 104B in the +R direction while being held on the development sleeve 104B by the pick-up pole S2. The developer G held on the development sleeve 104B passes through a space between the outer circumferential surface of the development sleeve 104B and the thickness regulating member 112 and thus the thickness of a layer of the developer G is regulated. The developer G having its thickness (amount) regulated by the thickness regulating member 112 is transported to a development area in which the developer G faces the photoconductor 22.

The thickness regulating member 112 is a columnar component having an axis extending in the Y direction and is made of, for example, stainless steel. As described above, the thickness regulating member 112 is disposed so as to face the layer forming pole N1.

Arrangement of Components of Developing Device

When the developing device 100 is viewed in the Y direction, the following positions are determined: P1 denotes the position of the center around which the first agitating member 106 rotates; P2 denotes the position of the +Z side end (or a upper end position) of the outermost circumference of the first agitating member 106; P3 denotes the position of the −Z side end (or a lower end position) of the outermost circumference of the first agitating member 106; P4 denotes the bottom of an inner wall 114A of the first agitating chamber 114; P5 denotes the position of the center around which the second agitating member 108 rotates;

P6 denotes the position of the +Z side end (or a upper end position) of the outermost circumference of the second agitating member 108; P7 denotes the position of the −Z side end (lower end position) of the outermost circumference of the second agitating member 108; and P8 denotes the bottom of an inner wall 116A of the second agitating chamber 116.

In FIG. 3, heights H1, H2, H3, H4, H5, and H6 in the Z direction from a bottom surface of the cabinet 11 (see FIG. 1) are drawn by broken lines extending in the X direction. Here, the heights in the Z direction have a relationship H1<H2<H3<H4<H5<H6.

In the developing device 100, for example, the bottom P4 of the first agitating chamber 114 and the bottom P8 of the second agitating chamber 116 are at the same level in the Z direction at the height H1. The lower end position P3 of the first agitating member 106 and the lower end position P7 of the second agitating member 108 are at the same level in the Z direction at the height H2.

In the developing device 100, the position of the center P1 of the first agitating member 106 in the Z direction is at the height H4 and the position of the center P5 of the second agitating member 108 in the Z direction is at the height H3. In addition, in the developing device 100, the upper end position P2 of the first agitating member 106 in the Z direction is at the height H6 and the upper end position P6 of the second agitating member 108 in the Z direction is at the height H5.

In the developing device 100, while the first agitating member 106 and the second agitating member 108 are rotating, the upper surface of the developer G contained in the first agitating chamber 114 and the upper surface of the developer G contained in the second agitating chamber 116 are at levels not higher than the upper end position P2 but not lower than the upper end position P6 in the Z direction. In addition, in the developing device 100, amounts of developer G transported by the first agitating member 106 and the second agitating member 108 per unit time are determined such that the upper surface of the developer G in the first agitating chamber 114 and the upper surface of the developer G in the second agitating chamber 116 are at the same level.

In order to position the upper surfaces of the developer G at levels not higher than the upper end position P2 but not lower than the upper end position P6 in the Z direction, parameters of the first agitating member 106 and the second agitating member 108 that contribute to a function of transporting the developer G only have to be appropriately determined. Examples of the parameters that contribute to a function of transporting the developer G include the outer diameters, the pitches, and the shaft diameters of the first agitating member 106 and the second agitating member 108, and the shapes and the thicknesses of the blade portions 106B and 108B. The examples of parameters also include clearances between the housing 102 and the first agitating member 106 and between the housing 102 and the second agitating member 108.

Figure 5:
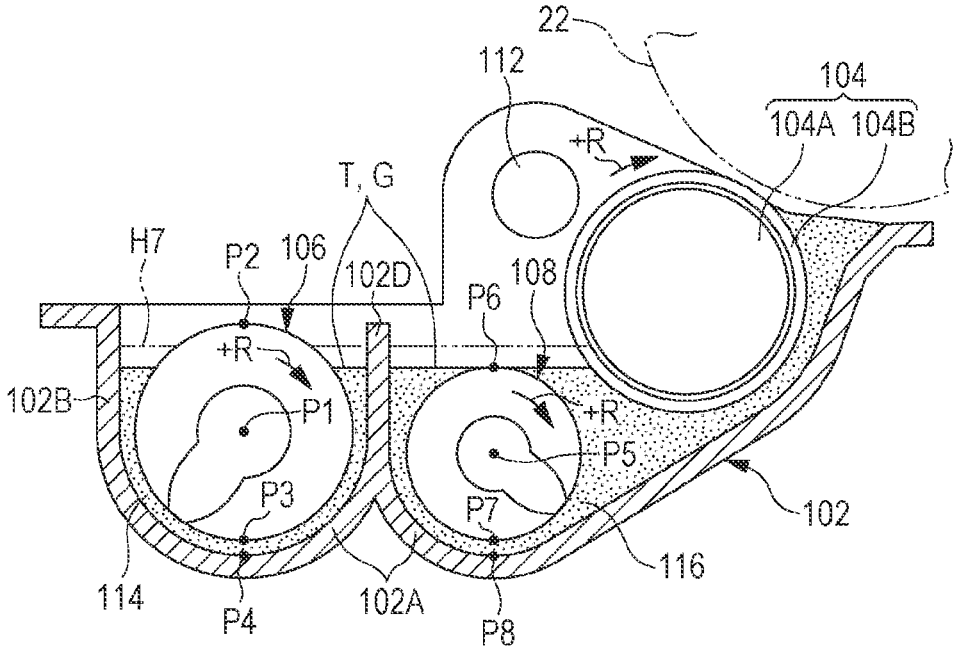
FIG. 5 is a vertical cross section of the developing device according to the exemplary embodiment in a state of containing toner.

FIG. 5 illustrates the first agitating member 106 and the second agitating member 108 of the developing device 100 in a state of being rotated in the +R direction to circularly transport the developer G inside the housing 102.

In the developing device 100, the bottom P4 of the first agitating chamber 114 and the bottom P8 of the second agitating chamber 116 are at the same level.

In addition, in the developing device 100, while the first agitating member 106 and the second agitating member 108 are rotating, the upper surface of the developer G in the first agitating chamber 114 and the upper surface of the developer G in the second agitating chamber 116 are at the same level.

In the developing device 100, the lower end position P3 of the first agitating member 106 having a larger diameter and the lower end position P7 of the second agitating member 108 having a smaller diameter are at the same level. The upper surface of the developer G in the first agitating chamber 114 and the second agitating chamber 116 is at a height H7 (drawn by a chain double-dashed line in FIG. 5), which is positioned between the upper end position P6 of the second agitating member 108 and the upper end position P2 of the first agitating member 106. Specifically, for example, the height H7 is at the same level as the upper end position P6 of the second agitating member 108. Thus, part of the outer circumference of the first agitating member 106 is exposed from the developer G. On the other hand, the second agitating member 108 is just under the developer G and there is scarcely any developer G that covers the second agitating member 108 from above at the upper end position P6.

The present invention is not limited to the above-described exemplary embodiment.

First Modification

Figure 6A:
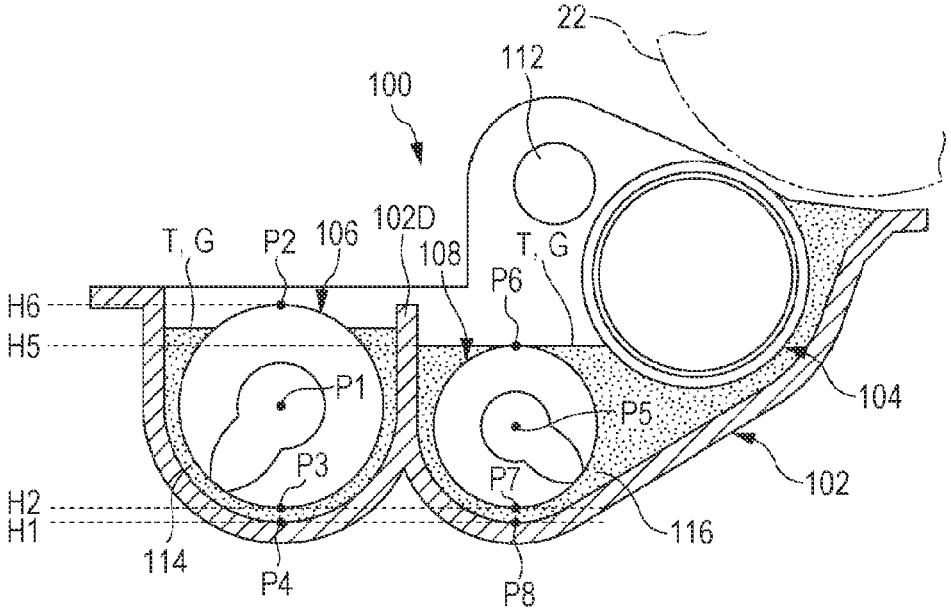
FIG. 6A is a vertical cross section of a developing device according to a first modification obtained by modifying the developing device according to the exemplary embodiment.

As illustrated in FIG. 6A, in the developing device 100, the upper surface of the developer G in the first agitating chamber 114 may be at a level not higher than the upper end position P2 but not lower than the upper end position P6 and the upper surface of the developer G in the second agitating chamber 116 may be at the same level as the upper end position P6. In other words, the upper surface of the developer G in the first agitating chamber 114 and the upper surface of the developer G in the second agitating chamber 116 may be at different levels as long as these levels fall within a range not higher than the upper end position P2 but not lower than the upper end position P6.

Second Modification

Figure 6B:
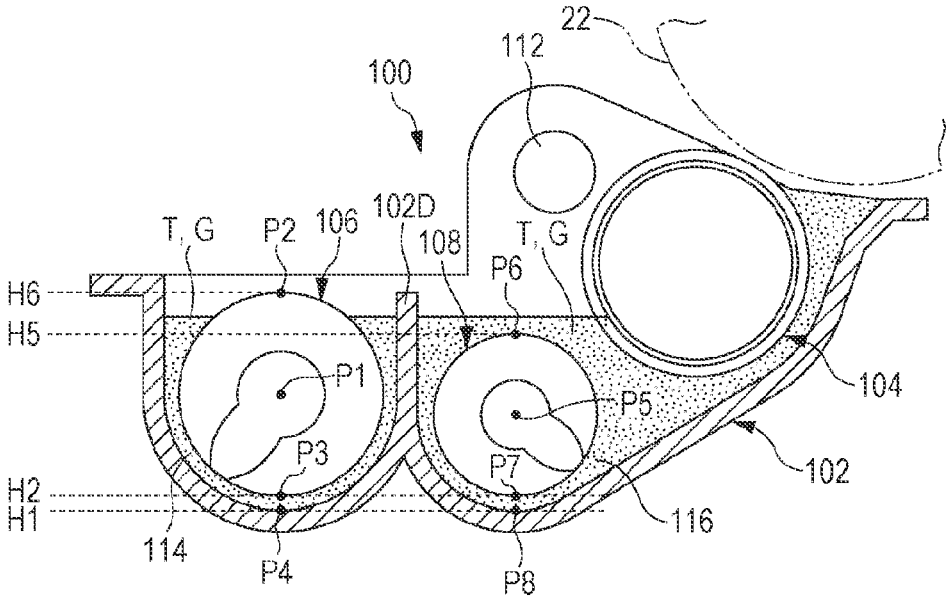
FIG. 6B is a vertical cross section of a developing device according to a second modification obtained by modifying the developing device according to the exemplary embodiment.

As illustrated in FIG. 6B, in the developing device 100, the upper surface of the developer G in the first agitating chamber 114 and the upper surface of the developer G in the second agitating chamber 116 may be at the same level at which the upper surfaces are higher than the upper end position P6 but lower than the upper end position P2.

Third Modification

Figure 7A:
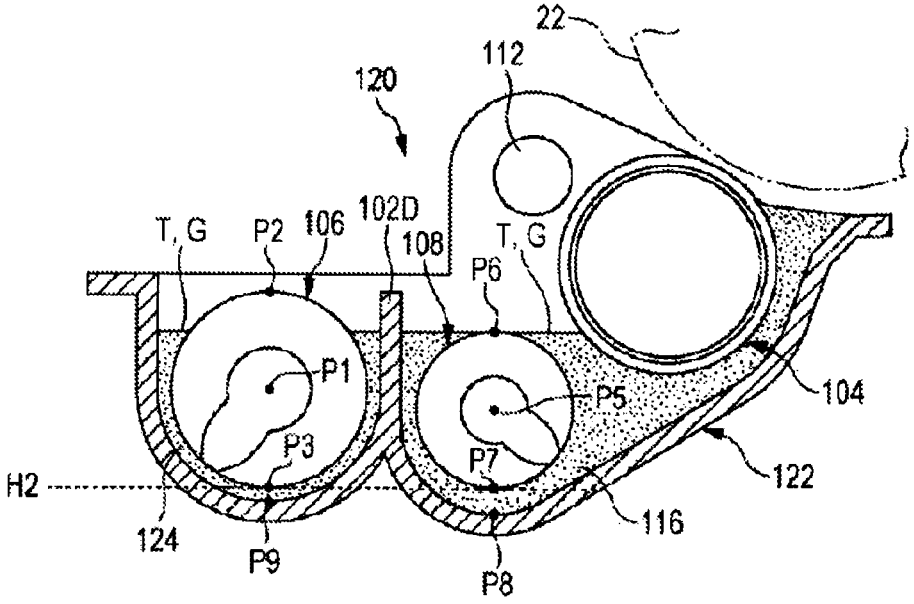
FIG. 7A is a vertical cross section of a developing device according to a third modification obtained by modifying the developing device according to the exemplary embodiment.

As illustrated in FIG. 7A, a developing device 120 including a housing 122 may be used instead of the developing device 100 including the housing 102 (see FIG. 3). The housing 122 includes a first agitating chamber 124 having a bottom P9 that is at a higher level than the bottom P8 of the second agitating chamber 116. The housing 122 includes the first agitating chamber 124 and the second agitating chamber 116.

Here, in the developing device 120, since the lower end position P3 of the first agitating member 106 and the lower end position P7 of the second agitating member 108 are at the same level, a clearance (gap) between the lower end position P3 and the bottom P9 is narrower than a clearance between the lower end position P7 and the bottom P8. The first agitating member 106 has a larger diameter than the second agitating member 108 and thus, in the third modification, the first agitating member 106 wobbles to a lesser extent during rotation than the second agitating member 108. Therefore, the first agitating member 106 rotates without touching the inner wall of the first agitating chamber 124 even though the clearance between itself and the first agitating chamber 124 is narrow.

Fourth Modification

Figure 7B:
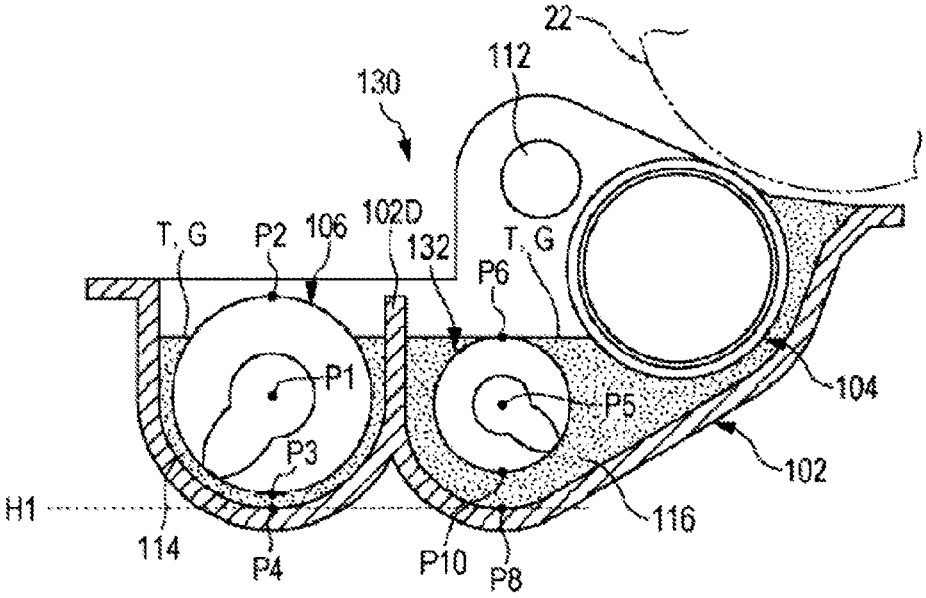
FIG. 7B is a vertical cross section of a developing device according to a fourth modification obtained by modifying the developing device according to the exemplary embodiment.

As illustrated in FIG. 7B, a developing device 130 including a second agitating member 132 may be used instead of the developing device 100 including the second agitating member 108 (see FIG. 3). The diameter of the second agitating member 132 is smaller than the diameter of the second agitating member 108. A lower end position P10 of the second agitating member 132 is at a higher level than the lower end position P3 of the first agitating member 106. In the developing device 130, the bottoms P4 and P8 of the housing 102 are at the same level.

Other Modifications

The first agitating member 106 and the second agitating member 108 are not limited to components each having a continuous helix and may be, for example, components each having blade portions whose circumferential positions are shifted per pitch. The image forming apparatus 10 is not limited to an apparatus that includes one first agitating chamber 114, one first agitating member 106, one second agitating chamber 116, and one second agitating member 108 and may include multiple first agitating chambers 114, multiple first agitating members 106, multiple second agitating chambers 116, and multiple second agitating members 108.

The image forming apparatus 10 is not limited to an apparatus that includes one developing device 100 (for a single color) and may be a color image forming apparatus that includes multiple developing devices 100 and transfers toner T of various different colors to a recording sheet P by using an intermediate transfer belt.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developing device comprising:

a developer container comprising a first chamber and a second chamber arranged along a lateral direction, which crosses a gravitational direction, developer circulating through the first chamber and the second chamber;

a transporting member rotatably disposed in the first chamber, the transporting member transporting the developer in a first direction extending along an axis of the transporting member; and a supply member rotatably disposed in the second chamber, the supply member having a maximum outermost diameter smaller than a maximum outermost diameter of the transporting member, the supply member supplying the developer to a developer holding member while transporting the developer in a second direction opposite to the first direction, wherein, while the supply member and the transporting member are rotating, an upper surface of developer contained in the first chamber and an upper surface of developer contained in the second chamber are at levels lower than an upper-most end position of the transporting member and higher than or equal to an upper end position of the supply member in the gravitational direction, and wherein a bottom of the first chamber and a bottom of the second chamber in the gravitational direction are at the same level, and wherein a lowermost end position of the transporting member in the gravitational direction level lower than a lowermost end position of the supply member in the gravitational direction.

2. The developing device according to claim 1, wherein, while the supply member and the transporting member are rotating, the upper surface of the developer contained in the second chamber is at the same level as the upper end position of the supply member in the gravitational direction.

3. The developing device according to claim 2, wherein an amount of developer transported by the supply member per unit time and an amount of developer transported by the transporting member per unit time are determined such that the upper surface of the developer contained in the first chamber and the upper surface of the developer contained in the second chamber are at the same level.

4. The developing device according to claim 1, wherein an amount of developer transported by the supply member per unit time and an amount of developer transported by the transporting member per unit time are determined such that the upper surface of the developer contained in the first chamber and the upper surface of the developer contained in the second chamber are at the same level.

5. An image forming apparatus comprising:

an image holding member configured to hold a latent image;

the developing device according to claim 1 configured to develop the latent image held on the image holding member with the developer of the developer holding member to form a developer image; and a transfer unit configured to transfer the developer image on the image holding member to a recording medium.

6. The developing device according to claim 1, wherein a rotational axis of the supply member and a rotational axis of the transporting member are offset in the gravitational direction.

7. The developing device according to claim 1, wherein a helix of the supply member is wound in a direction opposite to a direction in which a helix of the transport member is wound.

8. A developing device comprising:

a developer container comprising a first chamber and a second chamber arranged along a lateral direction, which crosses a gravitational direction, developer circulating through the first chamber and the second chamber;

a transporting member rotatably disposed in the first chamber, the transporting member transporting the developer in an axial direction; and a supply member rotatably disposed in the second chamber, the supply member having a maximum outermost diameter smaller than a maximum outermost diameter of the transporting member, the supply member supplying the developer to a developer holding member while transporting the developer in the axial direction, wherein a bottom of the first chamber and a bottom of the second chamber in the gravitational direction are at the same level, and wherein, while the supply member and the transporting member are rotating, an upper surface of developer contained in the first chamber and an upper surface of developer contained in the second chamber are at levels lower than an upper-most end position of the transporting member and higher than or equal to an upper end position of the supply member in the gravitational direction wherein a lowermost end position of the transporting member in the gravitational direction is at a level lower than a lowermost end position of the supply member in the gravitational direction.

9. The developing device according to claim 8, wherein, while the supply member and the transporting member are rotating, the upper surface of the developer contained in the second chamber is at the same level as the upper end position of the supply member in the gravitational direction.

10. The developing device according to claim 9, wherein an amount of developer transported by the supply member per unit time and an amount of developer transported by the transporting member per unit time are determined such that the upper surface of the developer contained in the first chamber and the upper surface of the developer contained in the second chamber are at the same level.

11. The developing device according to claim 8, wherein an amount of developer transported by the supply member per unit time and an amount of developer transported by the transporting member per unit time are determined such that the upper surface of the developer contained in the first chamber and the upper surface of the developer contained in the second chamber are at the same level.

12. An image forming apparatus comprising:

an image holding member configured to hold a latent image;

the developing device according to claim 8 configured to develop the latent image held on the image holding member with the developer of the developer holding member to form a developer image; and a transfer unit configured to transfer the developer image on the image holding member to a recording medium.

13. The developing device according to claim 8, wherein a helix of the supply member is wound in a direction opposite to a direction in which a helix of the transport member is wound.

* * * * *